US007004765B2

(12) United States Patent
Hsu et al.

(10) Patent No.: US 7,004,765 B2
(45) Date of Patent: Feb. 28, 2006

(54) NETWORK CONNECTOR MODULE

(75) Inventors: Han-Cheng Hsu, Taoyuan Hsien (TW); Chih-Tse Chen, Taoyuan Hsien (TW); Ching-Man Kao, Taoyuan Hsien (TW); Yeou-Jen Shieh, Taoyuan Hsien (TW)

(73) Assignee: Delta Electronics, Inc., (TW)

( * ) Notice: Subject to any disclaimer, the term of this patent is extended or adjusted under 35 U.S.C. 154(b) by 46 days.

(21) Appl. No.: 10/781,312

(22) Filed: Feb. 17, 2004

(65) Prior Publication Data

US 2005/0075012 A1 Apr. 7, 2005

(30) Foreign Application Priority Data

Oct. 6, 2003 (TW) ..... 92127705 A

(51) Int. Cl.
*H01R 12/00* (2006.01)

(52) U.S. Cl. ..... 439/79; 439/541.5

(58) Field of Classification Search ..... 439/67, 439/79, 80, 540.1, 541.5, 638
See application file for complete search history.

(56) References Cited

U.S. PATENT DOCUMENTS

| | | | | |
|---|---|---|---|---|
| 4,611,875 | A * | 9/1986 | Clarke et al. | 439/638 |
| 4,903,402 | A * | 2/1990 | Norton et al. | 29/843 |
| 5,397,241 | A * | 3/1995 | Cox et al. | 439/79 |
| 5,533,905 | A * | 7/1996 | Hio et al. | 439/76.2 |
| 6,080,011 | A * | 6/2000 | Tsao et al. | 439/541.5 |
| 6,592,401 | B1 * | 7/2003 | Gardner et al. | 439/544 |

* cited by examiner

*Primary Examiner*—Khiem Nguyen
(74) *Attorney, Agent, or Firm*—Michael A. Glenn; Glenn Patent Group

(57) ABSTRACT

A network connector module is described. The network connector module keeps a safe distance between signal pins and power pins to improve a signal transmission quality thereof. The network connector module includes a plurality of phone jacks, a plurality of pins and a second connector. The pins electrically couple to a circuit board to transmit signals. The second connector is fixed on an upper shell of the network connector module and utilizes a power cord to couple to the circuit board for transmitting power.

9 Claims, 3 Drawing Sheets

NETWORK CONNECTOR MODULE

FIELD OF THE INVENTION

The present invention relates to a network connector module and, in particular, to a power over ethernet (POE) network connector module.

BACKGROUND OF THE INVENTION

Information technology and the network industry are highly developed now. People utilize networks to search for information and provide services. Hence, the growing network provides humans with a comfortable and fast information search environment.

At this time, there is a lot of information to be distributed over the network. Therefore, a network established with only a few computers provides insufficient service. Network systems are established with more computers and the computer apparatuses may even be distributed in different places all over the world. The computer apparatuses, such as workstations, servers, database memory, routers, and backup devices, connect with each other via the network. Nowadays, almost every personal computer provides an interface to access the network, and even a notebook computer or a palm computer provides Internet function.

These computer apparatus connecting to each other via the network normally uses a connector, e.g. a standard RJ-45 phone jack, to couple to a hub. Therefore, the hub has a plurality of corresponding connectors, e.g. standard RJ-45 phone plugs, to couple with the connector of the computer apparatus. Each standard RJ-45 phone plug has to be inserted into each standard RJ-45 phone jack; therefore the dimensions of the standard RJ-45 phone plug and the standard RJ-45 phone jack have to fit exchangeable requirements.

Due to the highly progressive network requirement, the connecting ports of a hub are increased. Therefore, the number of RJ-45 phone jacks on a RJ-45 connector module of the hub has to be increased, as well. Additionally, the quantity of pins of the RJ-45 connector module is increased because the RJ-45 connector gets more appending functions. A density of contact holes, for coupling to the pins of the RJ-45 connector module, on a circuit board of the hub, is therefore increased.

Because the RJ-45 connector module has too many pins, an assembly problem is therefore caused. If even one pin is not aligned to the corresponding contact hole, the RJ-45 connector module cannot be smoothly installed on the circuit board. Therefore, the manufacture yield is reduced. Furthermore, the signals thereof may interfere with each other because many pins are too close, especially when a power pin is too close to a signal pin.

Therefore, the quantity of pins for directly inserting the contact holes of the circuit board can influence the quality and manufacture yield of the RJ-45 connector module fixed on the circuit board. The pins for transmitting power being too close to the pins for transmitting signals also influences the quality of the RJ-45 connector module. Accordingly, there is a need to improve the foregoing problems for increasing the manufacture quantity and quality.

SUMMARY OF THE INVENTION

One object of the present invention is to provide a network connector module to move some pins from a base of the network connector module to an upper shell thereof to reduce the quantity of pins directly coupling to the circuit board so as to make assembly more convenient.

Another object of the present invention is to provide a network connector module with a second connector to move pins for transmitting power from a base of the network connector module to an upper shell thereof and use a power cord to couple the second connector to the circuit board for reducing the quantity of pins directly coupling to the circuit board. The pins for transmitting power and the pins for transmitting signals are thus efficiently separated to enhance the signal quality.

The present invention provides a network connector module. The network connector module utilizes a separation of pins for transmitting signals and pins for transmitting power to reduce the signal distortion due to interference from power pins. The network connector module has a plurality of phone jacks, a plurality of pins, and a second connector. The pins connect with the phone jacks and electrically couple to a circuit board for transmitting signals. The second connector configured on an upper shell of the network connector module is utilized to transmit power with a power cord.

The phone jack can be a RJ-45 phone jack. The power for the network connector module is a power source for a signal filter, for a light-emitting diode (LED) indication, or for power over ethernet. The second connector can be configured on the upper cover, the sidewall, or the rear cover of the network connector module.

The network connector module according to the present invention utilizes the second connector to separate the pins for transmitting power and signals, and reduces the quantity of the pins on the base of the network connector module. An electrical equipment with the network connector module can be more easily and smoothly assembled. Therefore, the manufacture quality and product yield can be enhanced. Furthermore, because the second connector can efficiently enlarge the safety distance between the pins for transmitting power and signals, the signal transmission quality is also enhanced.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

The following description is of the best presently contemplated mode of carrying out the present invention. This description is not to be taken in a limiting sense but is made merely for the purpose of describing the general principles of the invention. The scope of the invention should be determined by referencing the appended claims.

Figure 1A:
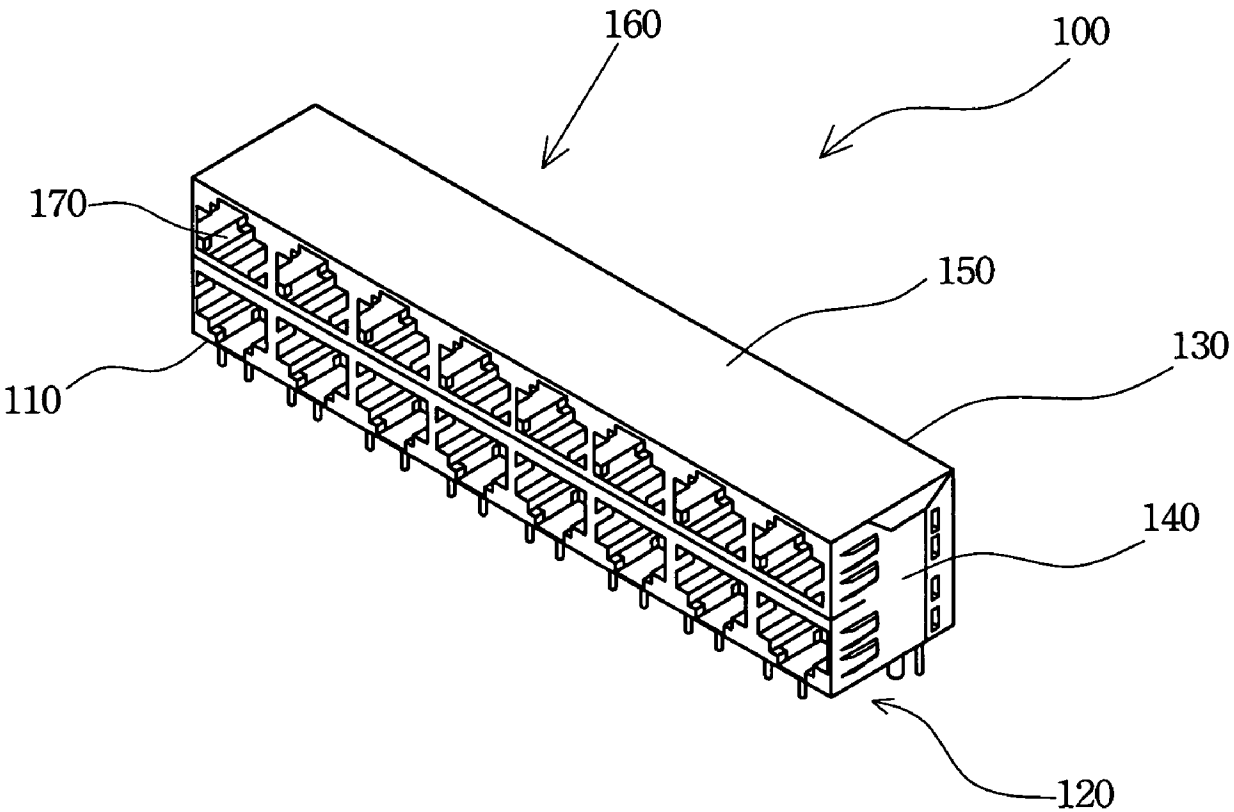
FIG. 1A is a schematic view of a network connector module according to the present invention.

FIG. 1A is a schematic view of a network connector module according to the present invention. The network connector module 100 has a base 110, an upper shell 130, a plurality of phone jacks, e.g. RJ-45 phone jacks 170, and a plurality of pins 120. The RJ-45 phone jack 170 is utilized to couple to a RJ-45 phone plug for transmitting signals and supplying power for an electrical network equipment with a power over ethernet (POE) technology.

Because the network connector module 100 has a plurality of RJ-45 phone jack 170, the pins 120 thereof are increased. However, a conventional RJ-45 connector modules has too many pins to transmit signals and power, especially when the conventional RJ-45 connector module provides functions of signal filters and light-emitting diode (LED) indications.

The conventional RJ-45 phone jack experiences a manufacturing bottleneck when these pins couple to a circuit board. Furthermore, these pins for transmitting power and signals are too close so that the signals may be distorted.

Figure 1B:
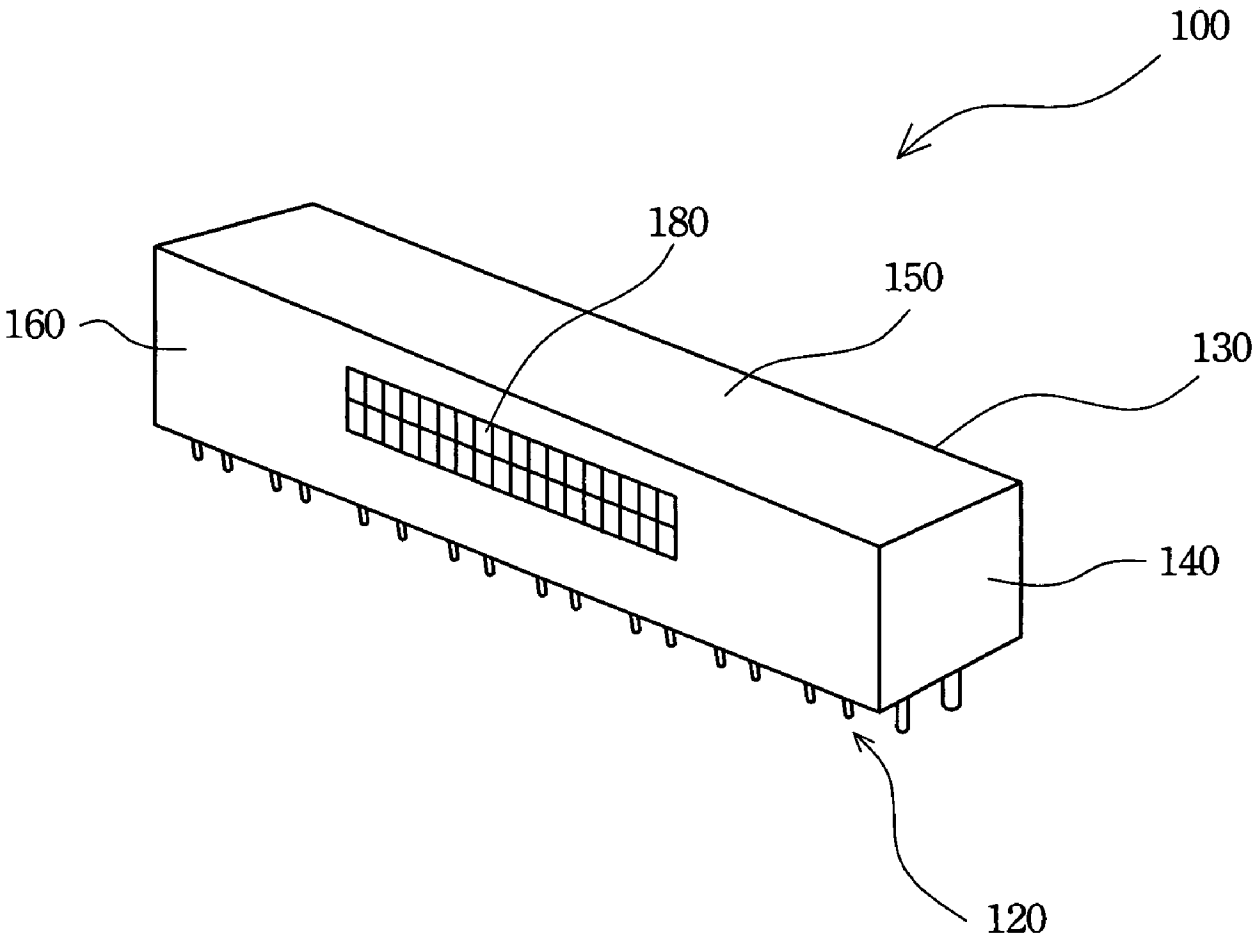
FIG. 1B is a schematic rear view of the network connector module of FIG. 1A.

FIG. 1B is a schematic rear view of the network connector module of FIG. 1A. Referring to FIG. 1B, the rear side of network connector module 100 further has a second connector 180 on the upper shell 130. The network connector module 100 according to the present invention utilizes a second connector 180 to move the pins for transmitting power from the base 110 to the upper shell 130.

The upper shell 130 includes sidewalls 140, an upper cover 150, and a back cover 160. The network connector module 100 utilizes the second connector 180 to transmit the electrical power on the upper shell 130, not on the base 110. The pins for transmitting signals and the pins for transmitting power are efficiently separated, and therefore the signal transmission quality is enhanced. The second connector 180 can be configured on any place of the upper shell 130, for example the back cover 160, the sidewall 140, or the upper cover 150.

The network connector module 100 with the second connector 180 changes the location of some pins for transmitting power to the upper shell 130, and therefore the quantity of the pins 120 on the base 110 is reduced. Accordingly, the network connector module 100 is easily and smoothly installed on the circuit board to enhance the manufacturing efficiency thereof and reduce the number of defective products.

The second connector 180 of the network connector module 100 needs only one power cord, e.g. a flexible flat cable, to transmit power for the network connector module 100 and the circuit board. The signal transmission quality is efficiently improved due to the separation of power transmission and signal transmission.

Figure 2:
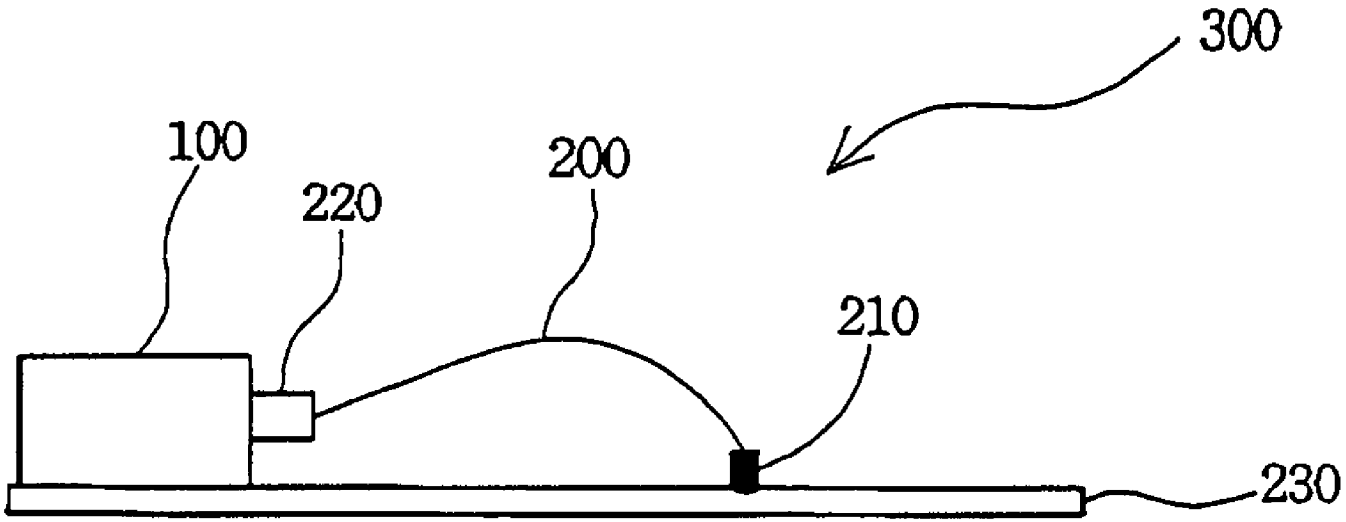
FIG. 2 is a schematic assembly view of the network connector module according to the present invention configured on a circuit board of an electrical equipment.

FIG. 2 is a schematic assembly view of the network connector module according to the present invention configured on a circuit board of a unit of electrical equipment. In the electrical equipment 300, the network connector module 100 is configured on a circuit board 230, and a power cord connector 220 of a power cord 200 is attached to the second connector 180 on the rear side of the network connector module 100 for coupling the network connector module 100 to the circuit board 230 to transmit power. Another end of the power cord 200 electrically couples to the circuit board 230 with a connecting device 210, e.g. a connector, or direct welding the power cord 200 on the circuit board 230.

The network connector module according to the present invention not only reduces the quantity of pins directly coupled to the circuit board but also increases safety distances between the pins for transmitting signals and the pins for transmitting power. Therefore, the manufacturing process can be smoother and the signal transmission quality can be enhanced.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. A network connector module comprising:

a plurality of phone jacks;

a plurality of pins connecting with the phone jacks and electrically coupling to a circuit board for transmitting signals of the network connector module; and a second connector configured on the network connector module to transmit power for the network connector module with a power cord coupling to the circuit board.

2. The network connector module of claim 1, wherein the phone jack comprises an RJ-45 phone jack.

3. The network connector module of claim 1, wherein the power for the network connector module is a power source for a signal filter, a power source for a light-emitting diode (LED) indication, or a power source for power over ethernet.

4. The network connector module of claim 1, wherein the network connector module comprises an upper cover, a sidewall, and a rear cover of the network connector module.

5. The network connector module of claim 4, wherein the second connector is configured on the upper cover, the sidewall, or the rear cover of the network connector module.

6. An electrical equipment with an RJ-45 connector module, the electrical equipment comprising:

a circuit board;

a power cord, wherein one end of the power cord has a power connector and another end of the power cord couples to the circuit board; and an RJ-45 connector module, wherein the RJ-45 connector module further comprises:

a plurality of RJ-45 phone jacks configured on the circuit board;

a plurality of pins connecting with the RJ-45 phone jacks and electrically coupling to the circuit board for transmitting signals of the RJ-45 connector module; and a second connector coupled to the power connector of the power cord and configured on the RJ-45 connector module to transmit power for the RJ-45 connector module with the power cord.

7. The electrical equipment with an RJ-45 connector module of claim 6, wherein a power source for the RJ-45 connector module is a power source for a signal filter, a power source for a light-emitting diode (LED) indication, or a power source for power over ethernet.

8. The electrical equipment with a RJ-45 connector module of claim 6, wherein the RJ-45 connector module comprises an upper cover, a sidewall, and a rear cover of the RJ-45 connector module.

9. The electrical equipment with a RJ-45 connector module of claim 6, wherein the second connector is configured on the upper cover, the sidewall, or the rear cover of the RJ-45 connector module.

* * * * *